US010920949B2

(12) United States Patent
Giraud

(10) Patent No.: US 10,920,949 B2
(45) Date of Patent: Feb. 16, 2021

(54) LUMINOUS DEVICE THAT IMAGES A VIRTUAL ILLUMINATED SURFACE OF A COLLECTOR

(71) Applicant: Valeo North America, Inc., Troy, MI (US)

(72) Inventor: Sylvain Giraud, Angers (FR)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 16/815,272

(22) Filed: Mar. 11, 2020

(65) Prior Publication Data

US 2020/0292144 A1 Sep. 17, 2020

(51) Int. Cl.

| | |
|---|---|
| ***F21S 41/32*** | (2018.01) |
| ***F21S 41/25*** | (2018.01) |
| ***F21S 41/148*** | (2018.01) |
| ***F21Y 115/10*** | (2016.01) |

(52) U.S. Cl.

CPC ..... *F21S 41/321* (2018.01); *F21S 41/148* (2018.01); *F21S 41/25* (2018.01); *F21Y 2115/10* (2016.08)

(58) Field of Classification Search

CPC ..... F21S 41/321; F21S 41/25; F21S 41/148
USPC ..... 362/516
See application file for complete search history.

(56) References Cited

U.S. PATENT DOCUMENTS

| | | | | |
|---|---|---|---|---|
| 7,607,811 | B2 * | 10/2009 | Okada | F21S 41/148 362/545 |
| 8,939,627 | B2 * | 1/2015 | Yatsuda | F21S 41/19 362/547 |
| 10,215,358 | B2 | 2/2019 | Han et al. | |
| 2003/0202359 | A1 * | 10/2003 | Albou | F21S 41/148 362/514 |
| 2004/0233678 | A1 * | 11/2004 | Ishida | F21S 41/153 362/539 |
| 2005/0083686 | A1 * | 4/2005 | Yatsuda | F21S 41/148 362/230 |
| 2005/0141227 | A1 * | 6/2005 | Tsukamoto | F21S 41/147 362/487 |
| 2005/0180158 | A1 * | 8/2005 | Komatsu | F21S 41/147 362/545 |
| 2010/0110716 | A1 * | 5/2010 | Nakada | F21S 41/148 362/538 |

(Continued)

FOREIGN PATENT DOCUMENTS

| | | | |
|---|---|---|---|
| EP | 1857731 | A2 | 11/2007 |
| FR | 3038695 | A1 | 1/2017 |

(Continued)

OTHER PUBLICATIONS

Republic of France, Preliminary Search Report for corresponding French Application No. 1902615, dated Nov. 4, 2019.

*Primary Examiner* — Bryon T Gyllstrom
(74) *Attorney, Agent, or Firm* — Valeo North America, Inc.

(57) ABSTRACT

The invention relates to a luminous device (2) for motor vehicles comprising a light source (4) that emits light rays; a collector (6) with a reflective surface (6.2) that collects and reflects light rays emitted by the light source (4); an optical system (10) that projects light rays from the reflective surface (6.2) into a light beam (12) along an optical axis of the device (8); and a mirror (7) that forms a virtual image (4, 6.2) from the light source (4) and the collector's (6) reflective surface where the optical system (10) forms a virtual image (4, 6.2).

18 Claims, 3 Drawing Sheets

(56) References Cited

U.S. PATENT DOCUMENTS

| | | | | |
|---|---|---|---|---|
| 2010/0309679 | A1* | 12/2010 | Yamagata | F21S 41/43<br>362/539 |
| 2014/0056018 | A1* | 2/2014 | Brendle | F21S 41/337<br>362/516 |
| 2014/0321140 | A1* | 10/2014 | Brendle | F21S 41/155<br>362/511 |
| 2014/0340923 | A1* | 11/2014 | Minami | F21S 41/36<br>362/516 |
| 2016/0186954 | A1* | 6/2016 | Han | F21S 41/36<br>362/509 |

FOREIGN PATENT DOCUMENTS

| | | | |
|---|---|---|---|
| FR | 3047541 | A1 | 8/2017 |
| JP | 2007287522 | A | 11/2007 |
| JP | 2009259468 | A | 6/2009 |

* cited by examiner

[Fig 1]
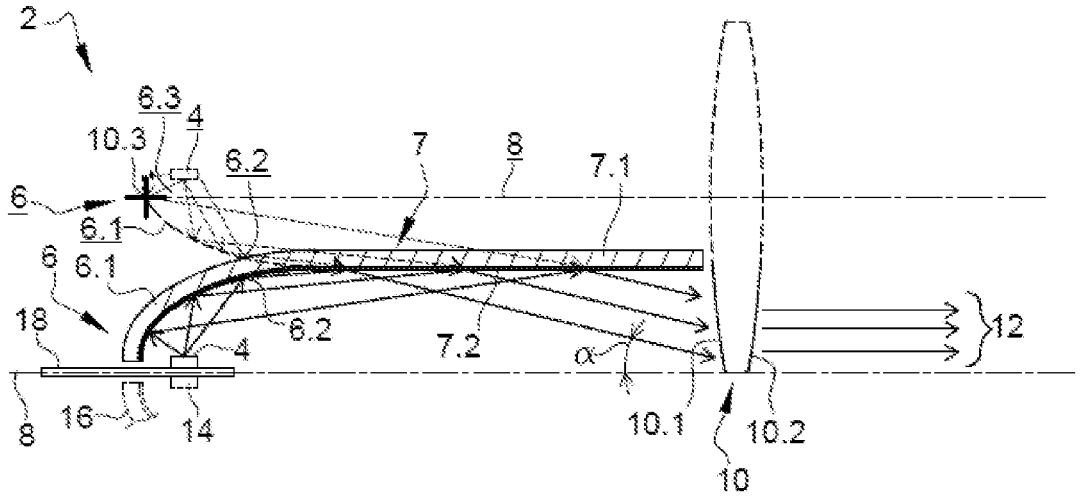
[Fig 2]
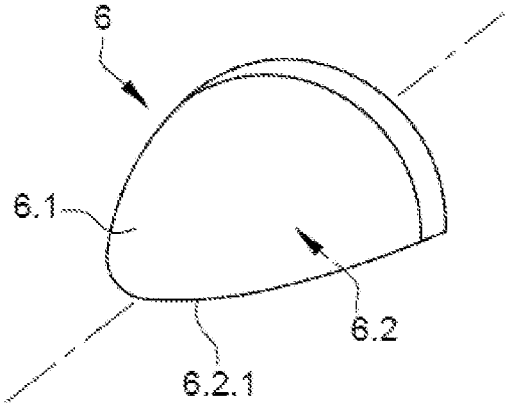
[Fig 3]
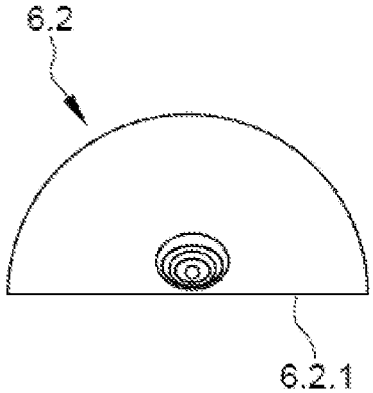

[Fig 4]
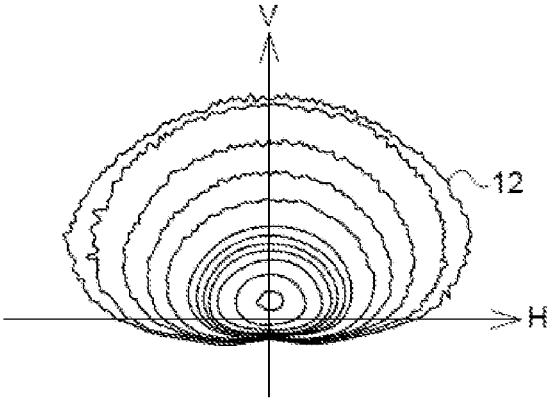
[Fig 5]
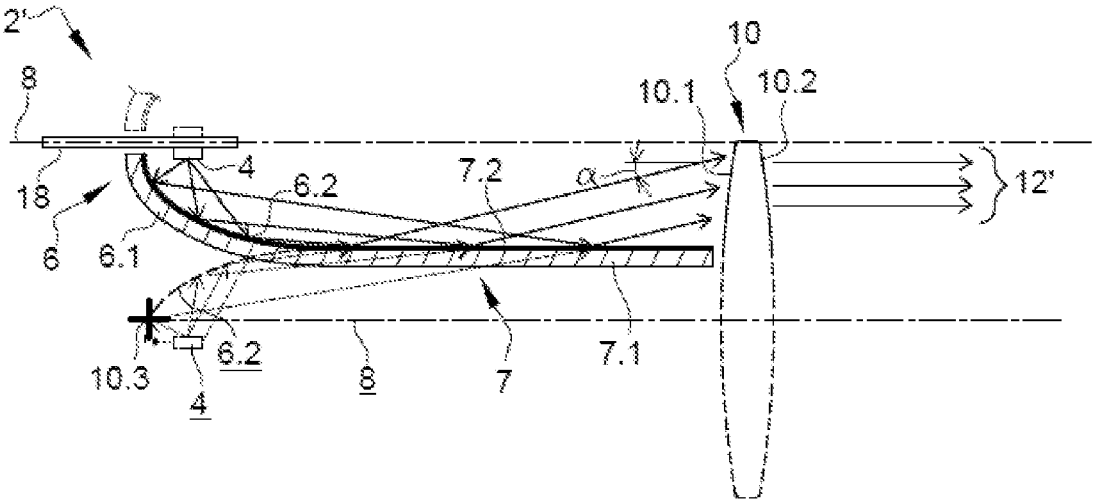
[Fig 6]
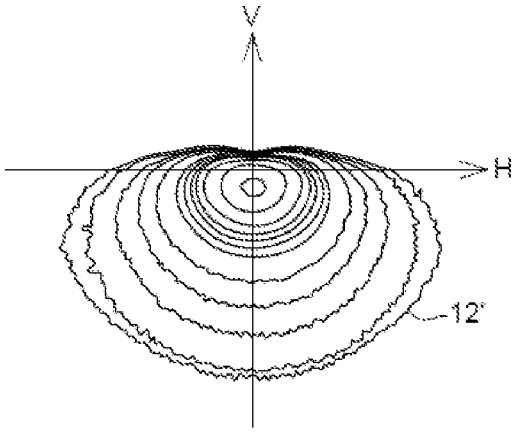

[Fig 7]
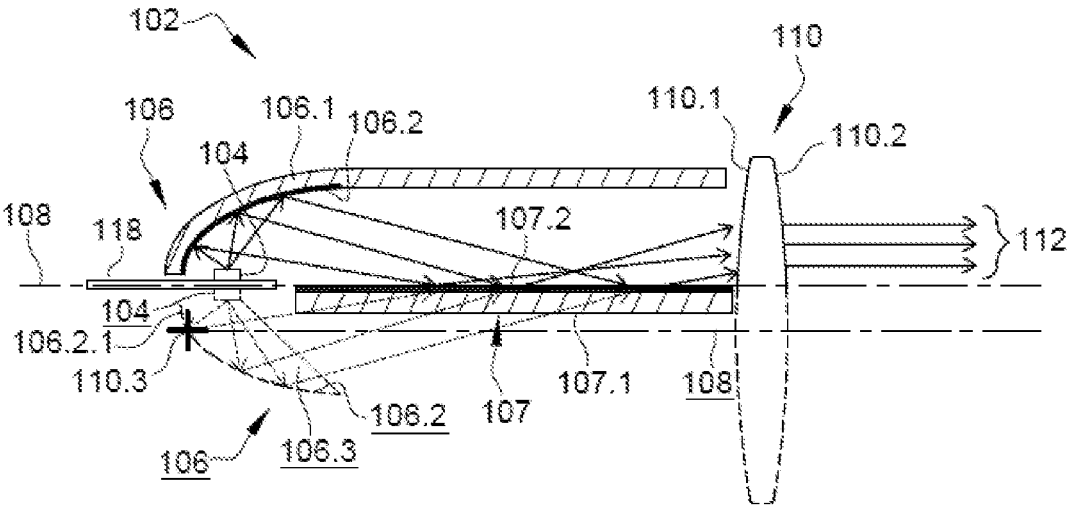
[Fig 8]
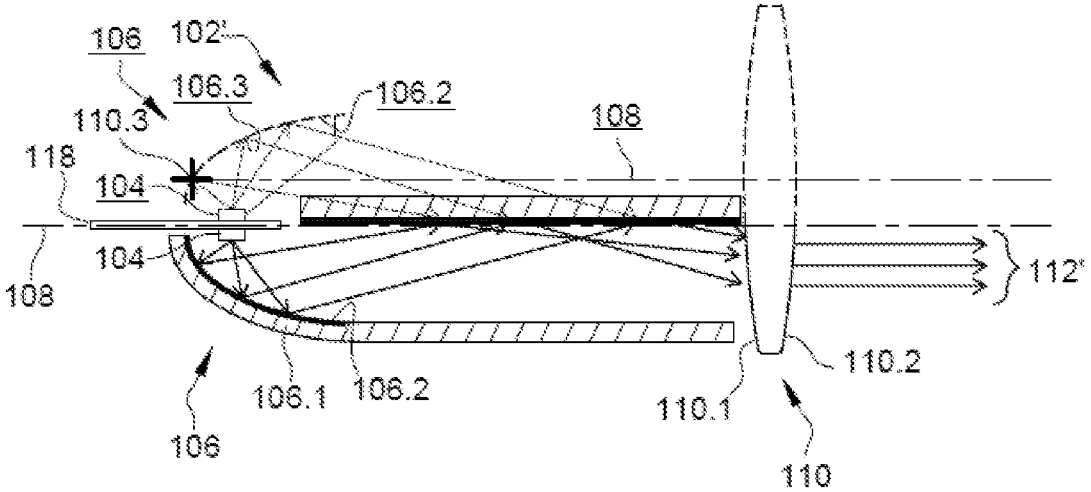

LUMINOUS DEVICE THAT IMAGES A VIRTUAL ILLUMINATED SURFACE OF A COLLECTOR

CROSS-REFERENCE TO RELATED APPLICATIONS

This application claims priority to French Application No. 1902615, filed Mar. 14, 2019, the disclosure of which is hereby incorporated in its entirety by reference herein.

TECHNICAL FIELD

The invention relates to the field of luminous lighting and signalling, and more particularly to the field of motor vehicles.

BACKGROUND

Published patent document FR 3 047 541 A1 discloses a lighting device comprising two optical modules placed opposite. Each of these two optical modules essentially comprises a light source and a collector with a reflective surface. These two light sources are placed on two opposite faces of a common carrier. Each of the reflective surfaces is a surface of revolution in a half-space bounded by the common carrier of the light sources. The two reflective surfaces thus form two half-shells opposite each other. One of the two optical modules is configured to form a lighting beam containing a flat cut-off, corresponding to a so-called low beam. To do this, the module comprises a reflective surface with an edge referred to as the "cut-off" edge, said edge being located at a focal point of the reflective surface. The rays that encounter the surface in question behind the cut-off edge are reflected toward an upper portion of a projecting lens whereas those that pass in front of the edge in question are not deviated and encounter a lower portion of the lens in question. This effect ensures an essentially flat cut-off of the beam. The other of the two optical systems essentially works in the same way, with the sole exception that the focal point of the reflective surface is located in front of the cut-off edge. The beam produced by the second optical system is combined with that of the first system to produce a high beam, i.e. a beam without a flat cut-off. This configuration is advantageous in that it exploits the cut-off-containing beam to produce a high beam.

Such a luminous device has the drawback of requiring a high precision in the positioning of the deflector and of the cut-off edge. Thus, the projecting lens must be a thick lens because of its small focal length, this increasing its weight and complicating the production thereof, in particular as regards sink marks. In addition, the collector has a certain height and, thus, a certain heightwise bulk.

SUMMARY

The objective of the invention is to mitigate at least one of the drawbacks of the aforementioned prior art. More particularly, the objective of the invention is to provide a luminous lighting and/or signalling module or device that is compact and that is more economical to produce.

The subject of the invention is a luminous device, in particular for a motor vehicle, said device comprising a light source able to emit light rays; a collector with a reflective surface configured to collect and reflect the light rays emitted by the light source; an optical system configured to project the light rays coming from the reflective surface into a light beam along an optical axis of the luminous device; noteworthy in that the luminous device comprises a mirror configured to form a virtual image of the light source and of the reflective surface of the collector, and the optical system is configured to form an image of said virtual image.

The light source and the reflective surface form a luminous module. A luminous module is able to form a light beam. The luminous device may comprise a plurality of luminous modules. In the presence of a single luminous module, the luminous device may be considered to be equivalent to the luminous module. The luminous device forms a stand-alone assembly in that each of the components thereof, such as for example the one or more light sources, the one or more collectors and the optical system, is rigidly fastened to the other components, in particular via a specific carrier (not detailed), and is thus optically positioned with respect to the other components. One or more luminous devices may thus be placed in a headlamp casing in order to perform, where appropriate in combination, all the required regulatory lighting and signalling functions.

According to one advantageous embodiment of the invention, the reflective surface of the collector and the mirror are configured so that the light rays reflected by a rear portion of said reflective surface are parallel to the optical axis or have, in a vertical plane with respect to said axis, an angle of inclination smaller than or equal to 25°, and preferably smaller than or equal to 10°.

According to one advantageous embodiment of the invention, the mirror is planar and parallel to the optical axis or is inclined with respect to said optical axis by an angle smaller than 10°.

According to one advantageous embodiment of the invention, the light source is configured to emit light rays in a main direction that is perpendicular to the optical axis or that is inclined with respect to a direction perpendicular to said optical axis by an angle smaller than 25°.

According to one advantageous embodiment of the invention, the reflective surface of the collector has a parabolic or elliptical profile. Preferably, it is a surface of revolution of said profile. The revolution is about an axis that advantageously is parallel to the optical axis. According to one variant, the reflective surface is a free-form surface or a swept surface or an asymmetric surface. It may also comprise a plurality of segments.

According to one advantageous embodiment of the invention, the mirror forms an extension, toward the optical system, of the reflective surface of the collector.

According to one advantageous embodiment of the invention, the reflective surface of the collector is configured to reflect the light rays emitted by the light source in a main direction that is divergent with the optical axis.

According to one advantageous embodiment of the invention, the mirror is formed on the collector.

According to one advantageous embodiment of the invention, the light source is placed on a substrate, the mirror being aligned with said substrate.

According to one advantageous embodiment of the invention, the reflective surface of the collector is configured to reflect the light rays emitted by the light source in a main direction that is convergent with the optical axis, said optical axis passing through the substrate.

According to one advantageous embodiment of the invention, the optical system has a focal point located in a region located between the virtual light source and the virtual reflective surface.

According to one advantageous embodiment of the invention, the focal point of the optical system is located on the virtual reflective surface, behind the virtual light source along the optical axis.

According to one advantageous embodiment of the invention, the optical system comprises a lens corresponding to a segment of a convergent lens centered on a virtual optical axis parallel to the optical axis and passing through the focal point of the optical system.

According to one advantageous embodiment of the invention, the reflective surface of the collector has a rear edge, the light beam being a beam containing a flat cut-off, said cut-off being an image of said rear edge.

According to one advantageous embodiment of the invention, the light source and the collector are located above the optical axis when the luminous device is in functional position, the cut-off of the light beam being a lower cut-off.

According to one advantageous embodiment of the invention, the light source and the collector are located below the optical axis when the luminous device is in functional position, the cut-off of the light beam being an upper cut-off.

According to one advantageous embodiment of the invention, the light source, the collector and the light beam are a first light source, a first collector and a first light beam, respectively, the luminous device comprising a second light source and a second collector with a reflective surface configured to collect and reflect the light rays emitted by the second light source, the optical system being configured to project the light rays coming from said reflective surface into a second light beam along an optical axis of the device and corresponding to an image of said reflective surface.

The first collector and the first light source form a first luminous module and the second collector and the second light source form a second luminous module.

Advantageously, the luminous device is configured so that the second light beam is a real image of the reflective surface of the second collector illuminated by the second light source. To this end, the light rays reflected by the reflective surface of the second collector are transmitted to the optical system without being reflected by a mirror, contrary to the light rays reflected by the reflective surface of the first collector.

According to one advantageous embodiment of the invention, the first collector and the first light source are opposite, with respect to the optical axis, to the second collector and to the second light source, respectively; or the first collector and the first light source, on the one hand, and the second collector and the second light source, on the other hand, are placed side-by-side.

The measures of the invention are advantageous in that they allow a luminous module or device that is compact, easy to assemble, contains few parts and that is able to perform various lighting and/or signalling functions to be produced. More particularly, the fact of imaging the illuminated reflective surface of the collector allows a light beam to be produced with a concentration of light in a vertically off-centered position in said beam. Thus, the invention allows the image produced to be flipped very easily and thus the one or more light beams to be modulated depending on the lighting and/or signalling functions to be performed (low-beam and high-beam lighting functions in particular).

Other features and advantages of the present invention will be better understood by virtue of the description and the drawings.

BRIEF DESCRIPTION OF THE DRAWINGS

FIG. 1 is a schematic representation of a luminous device according to a first embodiment of the invention.

FIG. 2 is a perspective view of the upper collector of the luminous device of FIG. 1.

FIG. 3 is a view of the illuminated interior surface of the collector of the luminous device of FIG. 1, from the exterior along the optical axis.

FIG. 4 is a graphical representation of the luminous image of the lighting beam produced by the luminous device of FIG. 1.

FIG. 5 is a schematic representation of a luminous device according to one variant of the first embodiment of the invention.

FIG. 6 is a graphical representation of the luminous image of the lighting beam produced by the luminous device of FIG. 5.

FIG. 7 is a schematic representation of a luminous device according to a second embodiment of the invention.

FIG. 8 is a schematic representation of a luminous device according to one variant of the second embodiment of the invention.

DETAILED DESCRIPTION

In the following description the notions of "above" and "below" the optical axis of the luminous device are to be understood with respect to the luminous device when it is in functional position, i.e. with an orientation that corresponds to that for which it was designed. Similarly, the notions "front" and "behind" are to be understood with respect to the general direction of the light, along the optical axis, when the device is in functional position.

FIGS. 1 to 4 illustrate a first embodiment of a luminous device according to the invention.

FIG. 1 is a schematic representation of the luminous device and of its operating principle. The luminous device 2 essentially comprises a light source 4, a collector 6 able to reflect the light rays emitted by the light source in order to form a first light beam 12 along an optical axis 8 of the device, and a lens 10 for projecting said beam. Projecting optical systems other than the projecting lens are envisionable, such as in particular one or more mirrors.

The light source 4 is advantageously a semiconductor light source, and in particular a light-emitting diode. The light source 4 emits light rays in a half-space bounded by the main plane of said source, in the shown example in a main direction perpendicular to said plane and to the optical axis 8. According to the invention, the main direction of emission will possibly be inclined with respect to a direction perpendicular to the optical axis by an angle smaller than or equal to 25°.

The collector 6 comprises a carrier 6.1, of shell or cap shape, and a reflective surface 6.2 on the interior face of the carrier 6.1. The reflective surface 6.2 is advantageously of elliptical or parabolic or free-form profile. The luminous device 2 also comprises a mirror 7 placed in the extension of the reflective surface 6.2 of the collector 6. The mirror 7 comprises a carrier 7.1 and a planar reflective surface 7.2 formed on the carrier 7.1. The latter may be merged with or adjacent to the carrier 6.1 of the collector. The reflective surface 6.2 of the collector 6 is advantageously a surface of revolution about an axis parallel to the optical axis 8. Alternatively, it may be a question of a free-form surface or a swept surface or an asymmetric surface. It may also comprise a plurality of segments. The expression "parabolic" generally applies to reflectors the surface of which has a single focal point, i.e. one region of convergence of the light rays, i.e. one region such that the light rays emitted by a light source placed in this region of convergence are projected to great distance after reflection from the surface. Projected to great distance means that these light rays do not converge toward a region located at least 10 times the dimensions of the reflector. In other words, the reflected rays do not converge toward a region of convergence or, if they converge, this region of convergence is located at a distance larger than or equal to 10 times the dimensions of the reflector. A parabolic surface may therefore comprise or not comprise parabolic segments. A reflector having such a surface is generally used alone to create a light beam. Alternatively, it may be used as projecting surface associated with an elliptical reflector. In this case, the light source of the parabolic reflector is the region of convergence of the rays reflected by the elliptical reflector.

The mirror 7, and more particularly its planar reflective surface 7.2, is advantageously parallel to the optical axis 8. It may however be inclined with respect to said axis, for example by an angle smaller than or equal to 10°. If it is inclined, the mirror is advantageously divergent with the optical axis in the main direction of propagation of the light, i.e. from the light source 4 to the projecting lens 10.

The shell- or cap-shaped collector 6 is advantageously made from materials having a good heat resistance, for example of glass or of synthetic polymers such as polycarbonate PC or polyetherimide PEI.

The light source 4 is placed at a focal point of the reflective surface 6.2 of the collector 6 so that the rays thereof are collected and reflected toward the mirror 7. The latter forms a virtual image 6.2 of the reflective surface 6.2 and a virtual image 4 of the light source 4, these having been shown with dashed lines in FIG. 1. The optical system 10 projects a luminous image of the virtual image 6.2 of the reflective surface 6.2 and the virtual image 4 of the light source 4. At least some of these rays reflected by the mirror 7 have angles of inclination a with respect to said axis, in a vertical plane, that are smaller than or equal to 25°, and preferably smaller than or equal to 10°, so as to be under so-called Gaussian conditions, allowing a stigmatism, i.e. a clearness of the projected image, to be obtained. It is advantageously a question of the rays reflected by the rear portion of the reflective surface 6.2 of the collector 6.

The projecting lens 10 has a first entrance face 10.1 and exit face 10.2. The lens 10 is said to be thin, for example with a thickness, along the optical axis, that is smaller than 7 mm, in particular because of the small lens height and the long focal length thereof. The lens 10 may have a focal point 10.3 that is advantageously located between the virtual light source and the virtual reflective surface. The focal point 10.3 in question is advantageously located in a region 6.3 located between the virtual images 6.2 and 4 of the reflective surface 6.2 and of the light source 4. In the present case, the focal point may be located on the virtual image 6.2 of the reflective surface 6.2, axially (i.e. along the optical axis) behind the virtual image 4 of the virtual light source 4. It will be noted that it is also possible for this focal point to be located behind or in front of the virtual image of the reflective surface 6.2 of the collector 6 provided that it is in proximity, and preferably within less than 10 mm, and preferably less than 5 mm, thereto.

It will also be noted that the lens 10 is advantageously a convergent lens that is symmetric with respect to the virtual optical axis 8 (dash-dotted line) located above the optical axis 8 and that advantageously passes through the focal point 10.3.

The reflective surface 6.2 of the collector 6, if it is elliptical, has a second focal point located in front of the lens 10 and at distance from the optical axis 8. It will be noted that it is also possible for this focal point to be located behind the lens and/or on the optical axis, provided that it is in proximity to the lens, so as to decrease the width of the beam on the entrance face of the lens.

The light source 4 and the collector 6 are advantageously a first light source and a first collector, the device then possibly comprising a second light source 14 and a second collector 16 (drawn with dashed lines). In the present case, the first light source 4 and the first collector 6, which form a first luminous module, and the second light source 14 and the second collector 16, which form a second luminous module, are opposite with respect to the optical axis 8. More particularly, the first and second light sources 4 and 14 are on opposite faces of a common substrate through which the optical axis 8 passes.

FIG. 2 is a view from behind, in perspective, of a rear portion of the collector 6 of the luminous device 2 of FIG. 1. The shell or cap shape of the carrier 6.1 and the fact that the reflective surface 6.2 (not shown) has a rear edge 6.2.1 may be seen. On account of the fact that the carrier 6.1 and, therefore, the reflective surface 6.2 form a preferably symmetric shell of revolution bounded by a plane, the plane in question comprises the rear edge 6.2.1. The latter lies in this plane laterally on either side of the axis of revolution. When the reflective surface 6.2 is lit by the light source, the entirety of the surface thereof is then illuminated, said surface in particular being bounded by the rear edge 6.2.1.

FIG. 3 is a representation of the light intensity on the reflective surface 6.2 of the collector seen from the exterior, along the optical axis. It is a question of the projected image of the virtual image of the reflective surface 6.2 of the collector, which image is produced by the mirror 7 (FIG. 1). More specifically, it is a question of the irradiance of the surface, namely the power per unit area of the electromagnetic radiation incident perpendicular to the direction of said surface, expressed in $W/m^2$. The dark region covering most of the surface corresponds to lower irradiances whereas the lighter central region corresponds to higher irradiances. It may be seen that the dark region is clearly bounded by the lower edge 6.2.1. In other words, the illuminated surface 6.2 naturally has a sharp lower edge able to form a cut-off in the projected lighting beam imaging this surface and also a concentration of light, in a central position located at the same height as the light source.

FIG. 4 is a graphical representation of the image projected by the luminous device of FIG. 1. The horizontal axis H and the vertical axis V cross on the optical axis of the luminous device. The curves are isolux curves, i.e. curves corresponding to regions of the light beam 12 in which the luminance expressed in lux is the same. The curves at the center correspond to a higher luminance level than on the periphery.

It may be seen in FIG. 4 that the light beam 12 contains a lower flat cut-off essentially level with the horizontal axis. The cut-off is not perfectly straight; it has a curvature that corresponds to aberrations in the image thus produced. In any case, the flat cut-off is produced by the edge 6.2.1 (FIG. 3), which is the rear edge (FIG. 2) of the reflective surface 6.2 of the collector 6. To this end, the focal point 10.3 of the lens 10 (FIG. 1) is advantageously located in proximity to this edge (FIG. 3) on the virtual reflective surface, i.e. behind the virtual image 4 of the (first) light source 4. It may also be seen that the light beam produced contains a high concentration of light above the horizontal axis H.

This light beam 12 is thus particularly suitable for performing a high-beam type lighting function complementary to a low-beam type lighting function.

FIG. 5 is a schematic representation of one variant of the luminous device 2 of the first embodiment of the invention, i.e. the embodiment illustrated in FIG. 1. This variant differs from FIG. 1 in that the components of the luminous device 2' have been flipped by 180° with respect to the optical axis 8, all else possibly being equal.

The light beam 12' produced is illustrated in FIG. 6, which is to be compared to FIG. 4. The luminous image may be seen to have been flipped, i.e. it contains an upper flat cut-off and a high concentration of light under and level with the horizontal axis. This light beam is particularly suitable for performing a low-beam type lighting function.

FIG. 7 is a schematic view of a luminous device according to a second embodiment of the invention. The reference numbers of the first embodiment have been used to designate corresponding or identical elements, these numbers however being increased by 100. Reference is moreover made to the description of these elements given in the context of the first embodiment. Specific numbers comprised between 100 and 200 are used to designate elements specific to this embodiment.

This second embodiment differs from the first embodiment of FIG. 1 essentially in that the mirror configured to form a virtual image of the light source and of the reflective surface is arranged differently, namely on the optical axis 108 or at least in proximity thereto. Specifically, the mirror 107 extends along the optical axis 108, the latter advantageously being aligned with the carrier of the light source 104. The reflective surface 106.2 of the collector is configured to reflect toward the mirror the rays emitted by the light source 104. These reflected rays correspond to virtual images 106.2 and 104 of the reflective surface 106.2 and of the light source 104, these having been drawn with dashed lines. The light beam 112 produced will then essentially correspond to the light beam 12 of the first embodiment, illustrated in FIG. 4.

Similarly to the first embodiment, the lens 110 may have a focal point 110.3 advantageously located between the virtual light source and the virtual reflective surface. The focal point 110.3 in question is advantageously located in a region 106.3 located between the virtual image 106.2 of the reflective surface 106.2 and the virtual image 104 of the light source 104. In the present case, the focal point may be located on the virtual image 106.2 of the reflective surface 106.2, axially (i.e. along the optical axis) behind the virtual image 104 of the light source 104. It will be noted that it is also possible for this focal point to be located behind or in front of the virtual image 106.2 of the reflective surface 106.2 of the collector 106 provided that it is in proximity, and preferably within less than 10 mm, and preferably less than 5 mm, thereto.

Again similarly to the first embodiment, the mirror 107, and more particularly its planar reflective surface 107.2, is advantageously parallel to the optical axis 108. It may however be inclined with respect to said axis, for example by an angle smaller than or equal to 10°.

Again similarly to the first embodiment, the light source 104 and the collector 106 are advantageously a first light source and a first collector, the device then possibly comprising a second light source and a second collector. In the present case, the first light source 104 and the first collector 106 on the one hand, and the second light source and the second collector on the other hand, may be opposite with respect to the optical axis 8. Alternatively, they may be placed side-by-side.

FIG. 8 is a schematic representation of one variant of the luminous device 102 of the second embodiment of the invention, i.e. the embodiment illustrated in FIG. 7. This variant differs from FIG. 7 in that the components of the luminous device 102' have been flipped by 180° with respect to the optical axis 108, all else possibly being equal.

The light beam 112' produced essentially corresponds to the light beam 12' produced by the luminous device of FIG. 5 and illustrated in FIG. 6. It is a question of a luminous image that is flipped with respect to that of the light beam 112 produced by the luminous device of FIG. 7, and that essentially corresponds to that of FIG. 4, i.e. it contains an upper flat cut-off and a concentration of light under and level with the horizontal axis H. This light beam is particularly suitable for performing a low-beam type lighting function.

Generally, the luminous devices that have just been described are particularly advantageous in that, by imaging the illuminated reflective surface, they allow light beams to be produced with a concentration of light in a vertically off-centered position. These beams are particularly useful for performing low-beam and high-beam functions. In addition, these luminous devices, via the use of a mirror, allow the light source and the collector associated with the light source to be flipped, and thus constraints on bulk to be accommodated.

The invention claimed is:

1. A luminous device (2; 102) of a motor vehicle, comprising:

a light source (4; 104) configured to emit light rays;

a collector (6; 106) with a reflective surface (6.2; 106.2) configured to collect and reflect the light rays emitted by the light source (4; 104);

an optical system (10; 110) configured to project the light rays coming from the reflective surface (6.2; 106.2) into a light beam (12; 112) along an optical axis of the luminous device (8; 108);

characterized in that the luminous device (2; 102) comprises a mirror (7; 107) configured to form a virtual image (4, 6.2; 104, 106.2) of the light source and of the reflective surface of the collector (6; 106), and the optical system (10; 110) is configured to form an image of said virtual image (4, 6.2; 104, 106.2), further characterized in that the optical system (10; 110) has a focal point (10.3; 110.3) located in a region located between the virtual image (4; 104) of the light source (4; 104) and the virtual image (6.2; 106.2) of the reflective surface (6.2; 106.2).

2. The luminous device (2; 102) according to claim 1, characterized in that the reflective surface (6.2; 106.2) of the collector (6; 106) and the mirror (7; 107) are configured so that the light rays reflected by a rear portion of said reflective surface (6.2; 106.2) are parallel to the optical axis (8, 108) or have, in a vertical plane with respect to said axis, an angle of inclination smaller than or equal to 25°, and preferably smaller than or equal to 10°.

3. The luminous device (2; 102) according to claim 1, characterized in that the mirror (7; 107) is planar and parallel to the optical axis (8; 108) or is inclined with respect to said optical axis by an angle smaller than 10°.

4. The luminous device (2; 102) according to claim 1, characterized in that the light source (4; 104) is configured to emit light rays in a main direction that is perpendicular to the optical axis (8; 108) or that is configured to emit light rays inclined with respect to a direction perpendicular to said optical axis by an angle smaller than 25°.

5. The luminous device (2; 102) according to claim 1, characterized in that the reflective surface (6.2; 106.2) of the collector (6; 106) has a parabolic or elliptical profile.

6. The luminous device (2) according to claim 1, characterized in that the mirror (7) forms an extension, toward the optical system (10), of the reflective surface (6.2) of the collector (6).

7. The luminous device (2) according to claim 6, characterized in that the mirror (7) is formed on the collector (6).

8. The luminous device (2) according to claim 1, characterized in that the reflective surface (6.2) of the collector (2) is configured to reflect the light rays emitted by the light source (4) in a main direction that is divergent with the optical axis (8).

9. The luminous device (102) according to claim 1, characterized in that the light source (104) is placed on a substrate (118), the mirror (7) being aligned with said substrate (118).

10. The luminous device (102) according to claim 9, characterized in that the reflective surface (106.2) of the collector (6) is configured to reflect the light rays emitted by the light source (104) in a main direction that is convergent with the optical axis (108), said optical axis passing through the substrate (118).

11. The luminous device (2; 102) according to claim 1, characterized in that the focal point (10.3; 110.3) of the optical system (10; 110) is located on the virtual image (6.2; 106.2) of the reflective surface (6.2; 106.2), behind the virtual image (4; 104) of the virtual light source (4; 104) along the optical axis (8; 108).

12. The luminous device (2; 102) according to claim 1, characterized in that the optical system comprises a lens (10; 110) corresponding to a segment of a convergent lens centered on a virtual optical axis (8; 108) parallel to the optical axis (8; 108) and passing through the focal point (10.3; 110.3) of the optical system.

13. The luminous device (2; 102) according to claim 1, characterized in that the reflective surface (6.2; 106.2) of the collector (6; 106) has a rear edge (6.2.1; 106.2.1), the light beam (12; 112) being a beam containing a flat cut-off, said cut-off being an image of said rear edge.

14. The luminous device (2; 102) according to claim 13, characterized in that the light source (4; 104) and the collector (6; 106) are located above the optical axis (8; 108) when the luminous device is in functional position, the cut-off of the light beam (12; 112) being a lower cut-off.

15. The luminous device (2'; 102') according to claim 13, characterized in that the light source (4; 104) and the collector (6; 106) are located below the optical axis (8; 108) when the luminous device is in functional position, the cut-off of the light beam (12'; 112') being an upper cut-off.

16. The luminous device (2) according to claim 1, characterized in that the light source (4; 104), the collector (6; 106) and the light beam (12; 112) are a first light source, a first collector and a first light beam, respectively, the luminous device comprising a second light source (14) and a second collector (16) with a reflective surface configured to collect and reflect the light rays emitted by the second light source (14), the optical system (10; 110) being configured to project the light rays coming from said reflective surface into a second light beam along an optical axis of the device and corresponding to an image of said reflective surface.

17. The luminous device according to claim 16, characterized in that the first collector (6; 106) and the first light source (4; 104) are opposite, with respect to the optical axis (8; 108), to the second collector (16) and to the second light source (14), respectively; or the first collector and the first light source, on the one hand, and the second collector and the second light source, on the other hand, are placed side-by-side.

18. A luminous device of a motor vehicle, comprising:

a light source configured to emit light rays;

a collector with a reflective surface configured to collect and reflect the light rays emitted by the light source;

an optical system configured to project the light rays coming from the reflective surface into a light beam along an optical axis of the luminous device;

wherein in the luminous device comprises a mirror configured to form a virtual image of the light source and of the reflective surface of the collector, and the optical system is configured to form an image of said virtual image, further wherein the optical system has a focal point located in a region located between the virtual image of the light source and the virtual image of the reflective surface; furthermore wherein the focal point of the optical system is located on the virtual image of the reflective surface, behind the virtual image of the virtual light source along the optical axis and the optical system comprises a lens corresponding to a segment of a convergent lens centered on a virtual optical axis parallel to the optical axis and passing through the focal point of the optical system.

* * * * *